US006461245B1

(12) United States Patent
Morgan

(10) Patent No.: US 6,461,245 B1
(45) Date of Patent: Oct. 8, 2002

(54) GOLF IMPROVEMENT SYSTEM

(76) Inventor: Thomas H. Morgan, 2428 Stone Heath Dr., Lancaster, PA (US) 17601

( * ) Notice: Subject to any disclaimer, the term of this patent is extended or adjusted under 35 U.S.C. 154(b) by 0 days.

(21) Appl. No.: 09/311,746

(22) Filed: May 14, 1999

(51) Int. Cl.[7] ..... A63B 69/36
(52) U.S. Cl. ..... 473/131; 473/283
(58) Field of Search ..... 473/131, 282, 473/283, 409; 700/92

(56) References Cited

U.S. PATENT DOCUMENTS

| | | | | |
|---|---|---|---|---|
| 3,665,494 A | | 5/1972 | Baumoel | |
| 4,666,157 A | | 5/1987 | Bodine et al. | |
| 5,013,069 A | * | 5/1991 | Hardin | 283/48.1 |
| 5,319,548 A | | 6/1994 | Germain | |
| 5,504,312 A | * | 4/1996 | Morrison et al. | 235/375 |
| 5,507,485 A | | 4/1996 | Fisher | |
| 5,558,333 A | * | 9/1996 | Kelsin et al. | 473/131 |
| 5,562,550 A | | 10/1996 | Chartrand | |
| 5,636,872 A | * | 6/1997 | Gamer et al. | 283/49 |
| 5,681,108 A | * | 10/1997 | Miller | 364/411 |
| 5,779,566 A | | 7/1998 | Wilens | |
| 5,810,680 A | * | 9/1998 | Lobb et al. | 473/407 |
| 5,882,269 A | | 3/1999 | Lewis | |
| 6,062,991 A | * | 5/2000 | Moriarty et al. | 473/407 |

* cited by examiner

*Primary Examiner*—Joe H. Cheng
*Assistant Examiner*—K. Nguyen
(74) *Attorney, Agent, or Firm*—Shlesinger, Arkwright & Garvey LLP

(57) ABSTRACT

A golf improvement system comprises a club and course registration form containing information about a course including par of each hole and distance from a tee to a green; a player score card for recording a round of golf played by the player on the course, the score card including a plurality of circles corresponding to each hole, each circle when filled in corresponding to a data entry concerning the hole being played; a computerized database containing information from the club and registration form, the player score card, and information on the player's peer group; and a report generated by the computerized database and containing statistics on the player's playing skills.

31 Claims, 12 Drawing Sheets

GOLF IMPROVEMENT SYSTEM

FIELD OF THE INVENTION

The present invention relates to a game improvement system that provides the amateur golfer with feedback based on the player's actual playing experiences compared to his handicap peer group. The present invention also relates to a device for recording a player's playing skills in a round of golf.

BACKGROUND OF THE INVENTION

The game of golf can be played for a lifetime, but should not take a lifetime to learn. An aid to learning the game is to identify the strengths and weaknesses of the player's game and track his performance over several rounds. Not only is it helpful for the player to know his own performance, but it is also helpful for him to know how he compares to his peer group. Knowing how he is performing relative to his own peer group and his lower peer group would give him a level of performance to which he can aspire to further improve his game. As the player's knowledge and understanding of his game grows, his plan for improvement becomes more effective.

One way to learn and improve one's game is to hire a club professional who would accompany the player during a round of golf to record the player's score and stroke play and other important facts. However, employing such an individual could be expensive, which may act as deterrent to the player from taking lessons from a golf professional.

There are several prior art devices and systems that are available to help the amateur golf player to improve his game. However, these devices and systems can be cumbersome to use, especially those requiring some computer proficiency, thereby discouraging the player from consistently using them.

There is, therefore, a need for a golf playing system that will track a player's performance over several rounds of golf throughout the year and compare his playing abilities with his peer group and the next lower peer group, be easy to use and not require an inordinate amount of time to learn and use.

OBJECTS AND SUMMARY OF THE INVENTION

It is an object of the present invention to provide a golf improvement system that records the player's performance on each hole and track his performance over several rounds.

It is another object of the present invention to provide a golf improvement system that compares a player's performance over several rounds to his peer group.

It is still another object of the present invention to provide a golf improvement system that provides a detailed report on the player's playing skills, namely, driving, approaching, full wedge play, chipping and pitching, sand saving, putting, and penalty avoidance, relative to his peer group and the next lower peer group.

It is still another object of the present invention to provide a golf improvement system that provides a report on the player's playing skills to help him to understand course management, his strengths, the shots he has mastered and the ones he must learn.

It is yet another object of the present invention to provide a golf improvement system that uses a player score card that is relatively easy to use, requiring only that a mark, such as filling in a circle, be made on the card to make an entry against one of a few pre-printed questions in respect of each hole.

It is another object of the present invention to provide a golf improvement system that uses a player practice record form to keep track of the amount of time the player spends off the course practicing the game.

In summary, the present invention provides a golf improvement system, comprising a club and course registration form containing information about a course including par of each hole and distance from a tee to a green; a player score card for recording a round of golf played by the player on the course, the score card including a plurality of circles corresponding to each hole, each circle when filled in corresponding to a data entry concerning the hole being played; a computerized database containing information from the club and registration form, the player score card, and information on the player's peer group; and a report generated by the computerized database and containing statistics on the player's playing skills.

The present invention also provides a device for keeping record of a player's playing ability during a round of golf, comprising a score card for recording a round of golf played by the player on a course. The score card includes a list of holes disposed along a vertical axis and a list of selectable data disposed along a horizontal axis; and a plurality of rows of circles, each row corresponding to each hole, each circle in the row corresponding to one of the selectable data such that a circle when filled in represents a data entry for the hole being played and the corresponding selectable data.

The present invention further provides a method for improving a player's game of golf, comprising inputting data pertaining to a golf course into a computer database; recording information on a player's several rounds of golf for each hole, including score, whether he reached fairway in regulation, distance to the green following a tee shot, type of shots made, distance of first putt, number of putts, and type of shot before first putt; inputting the information into a computerized database; and generating a report from the computerized database, the report containing statistics on the player's playing skills.

These and other objects of the present invention will become apparent from the following detailed description.

BRIEF DESCRIPTIONS OF THE DRAWINGS

DETAILED DESCRIPTION OF THE INVENTION

Figure 1:
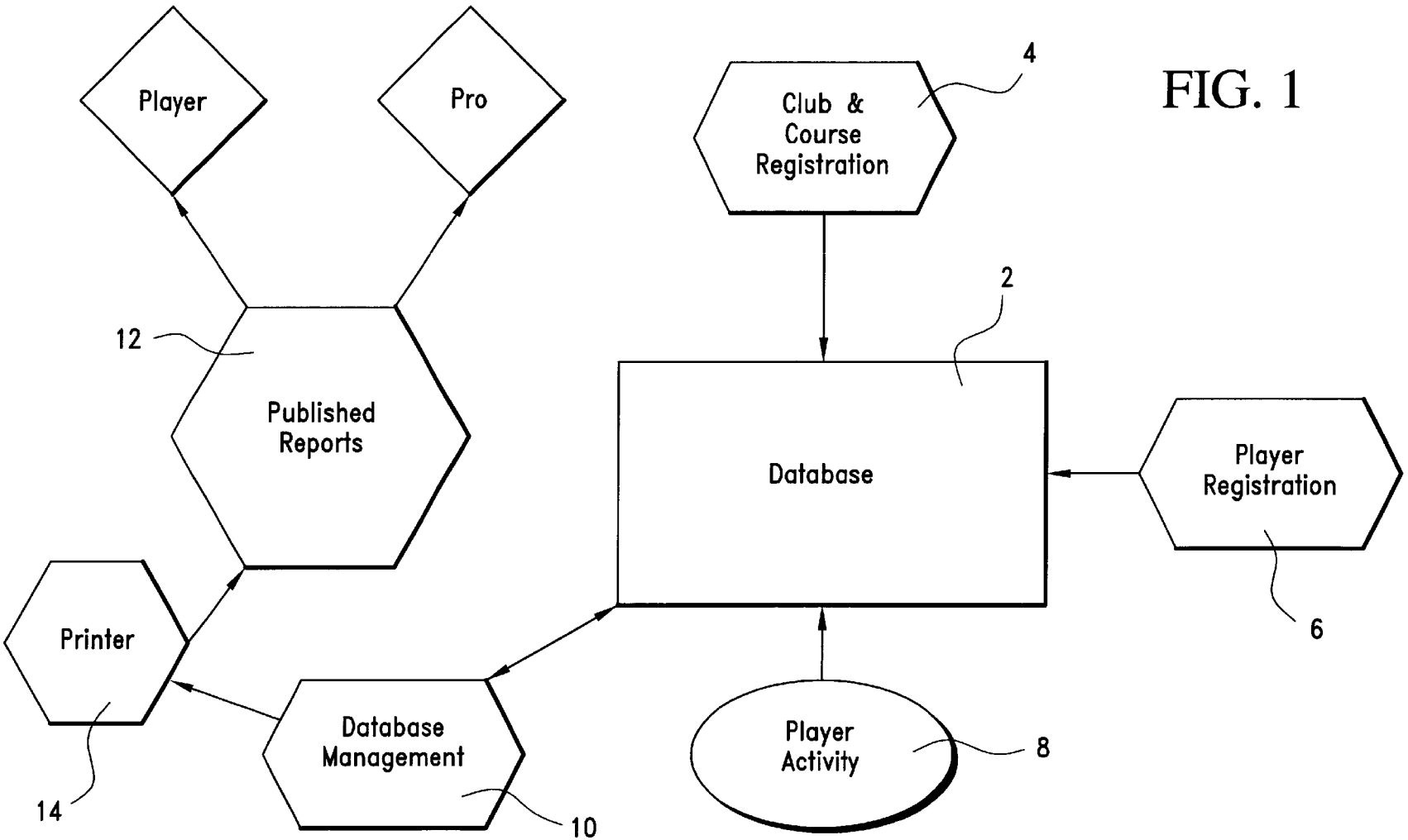
FIG. 1 is a schematic block diagram of the present invention.
Figure 2:
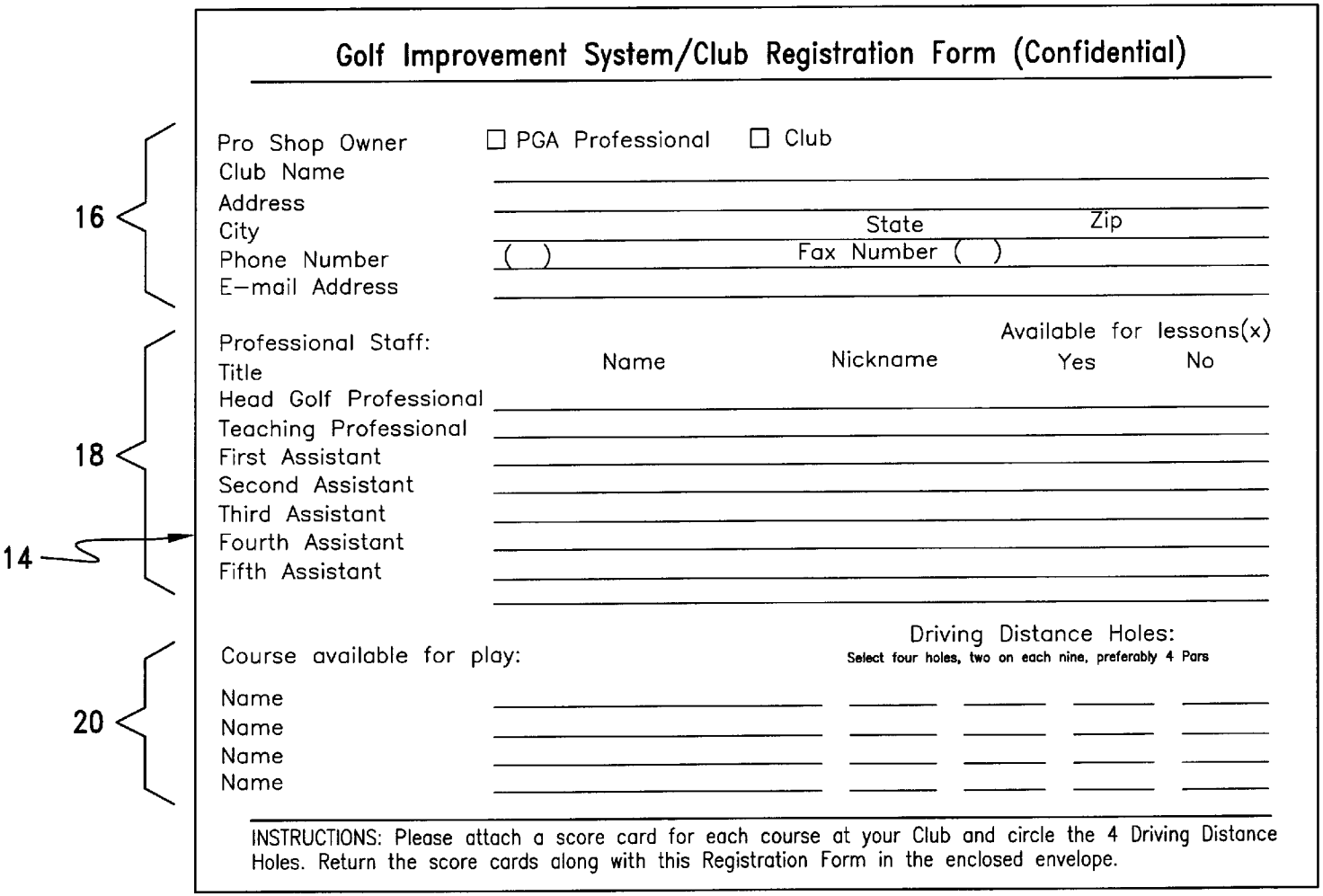
FIG. 2 is a club registration form filled out by a club professional for use in the present invention.

A golf improvement system R made in accordance with the present invention is disclosed in FIG. 1. The system R includes a computerized database 2 that includes data obtained from club and course registration 4, player registration 6, and player activity 8. A database management software maintains the database 2 and provides statistical routines to generate a report 12 by means of a printer 14. The report 12 provides an analysis on the player's playing abilities as compared to the player's handicap peer group and the next lower peer group. The report 12 is provided to the player and the club professional with whom the player can schedule a meeting to discuss the report and help the player focus on his strengths and weaknesses to improve his game.

Club and course registration 4 is accomplished by means of a registration form 14 filled out by the club or entity that owns the golf course. The registration form includes an area 16 for entering the name of the club and other related information. An area 18 is provided for entering the names of the professional staff at the club.

The registration form 14 includes an area 20 for indicating the name of the courses available for use by the player and four holes, two on each nine-hole course, and their respective driving distances from the tee to the green.

Once all the information have been provided on the form 14, the information is entered electronically into the database 2 manually or electronically by means of a fax machine, card reader, scanner or other standard devices. The information provided by the form 14 will provide details and insights into the player's course management skills.

Figure 3:
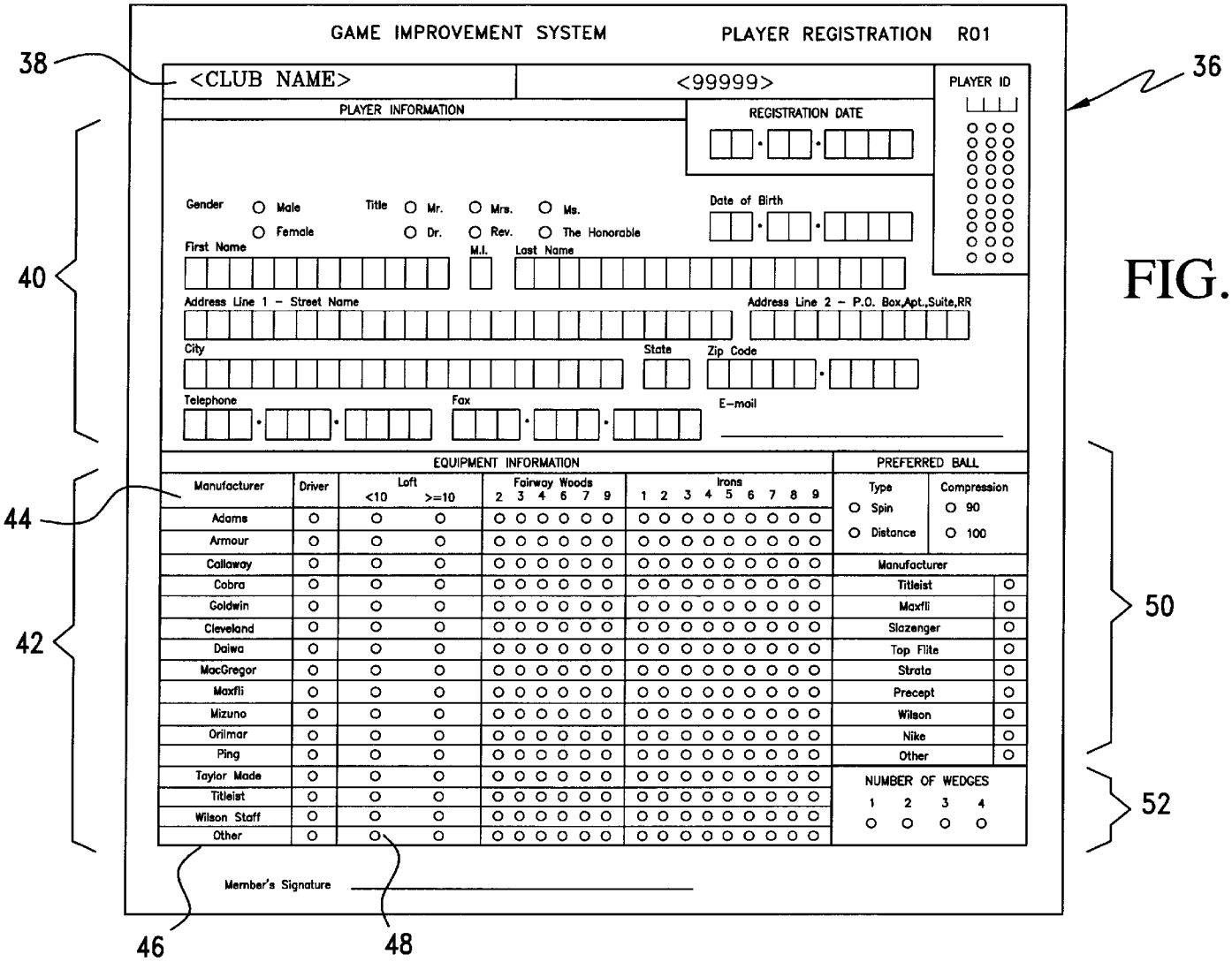
FIG. 3 is a player registration card for use in the present invention.
Figure 4:
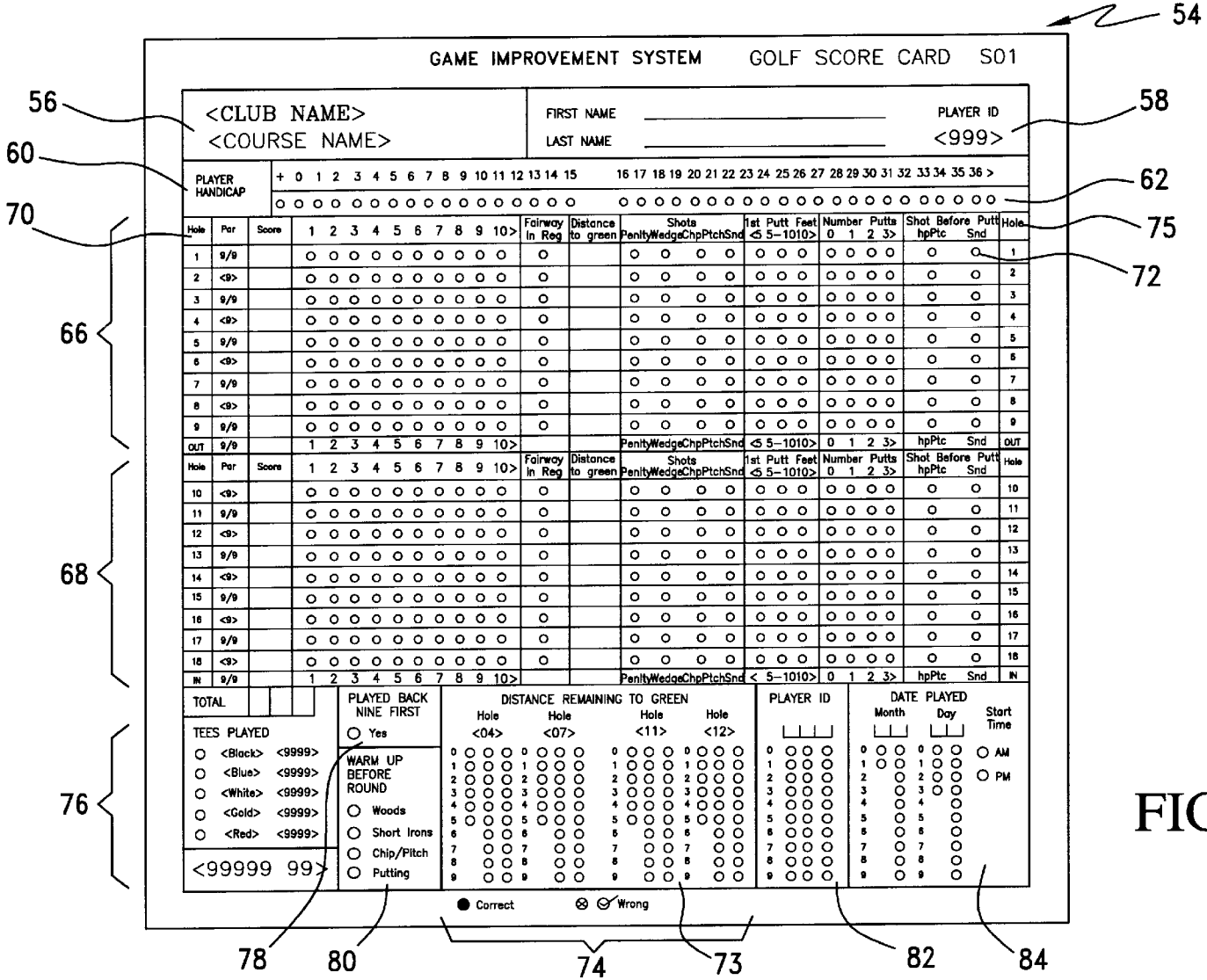
FIG. 4 is a score card used by a player during a round of golf.

After the club and course information have been entered into the database 2, a player desiring to play on the course and have his playing abilities analyzed registers with the database by means of a player registration form 36, as best shown in FIG. 3. The registration form 36 includes an area 38 where the club name is preprinted. An area 40 is provided for receiving personal information about the player, such as name, address, etc.

The registration form 36 includes an area 42 for recording information on the equipment to be used by the player. The area 42 is advantageously arranged in a matrix or tabular format for ease of use. The area 42 includes a first row 44 having preprinted headings for Manufacturer, Driver, Loft (<10, >=10), Fairways Woods (2–5, 7, 9), and Irons (1–9). A left-hand column 46 provides a list of manufacturers. A row of circles 48 lines up with each manufacturer and each item in the first row 44 so that the player merely fills in the appropriate circle to identify his equipment. An area 50 is also provided for indicating the player's preferred ball, including type, compression and manufacturer. In addition, the number of wedges is entered at area 52.

After the player is registered, he is provided with a player score card 54 made specific to the course. The score card 54 is preprinted with the club name and course name at area 56. The score card 54 is also preprinted with the player's name and identification number at area 58. Area 60 includes a row of circles 62, each one corresponding to a (+) sign and a number from 0–36 and greater, for entering the player's handicap. The appropriate circle is filled to indicate the player's handicap. If the player is a scratch or lower, the circle under the heading (+) is selected.

Areas 66 and 68 are provided for entering information on the player's playing ability as he plays each hole. only area 66 will be discussed, since the layout for 68 is identical to that of area 66. Area 66 is arranged in tabular or matrix format for entering information the player's score and other information for each hole. The area 66 includes a first row containing preprinted headings for Hole, Par, Score, 1–10>, Fairway in Regulation, Distance to Green, Shots—Penalty, Wedge, Chip/Pitch, Sand, 1st Putt-Feet—<5, 5–10, 10>, Number of Putts—0, 1, 2, 3>, Shot Before Putt—Chip/Pitch, Sand, and Hole. A left-hand column 70 on a vertical axis provides a preprinted list of holes. A row of circles 72 lines up with each hole and each circle lines up with a respective heading item in the first row 75 on a horizontal axis so that the player merely fills in the appropriate circle to indicate the appropriate information requested for that hole. Except for the heading Distance to Green, each circle is uniquely associated with a hole and an item in the heading. The items in the heading represent selected data when the respective circles are filled in. Data entry is made simply by filling in the correct circle.

The par information in area 66 is provided by the club for each hole.

Blank spaces are provided under the heading Score to allow the player to numerically enter his score for each hole. The appropriate circle corresponding to one of the numbers 1–10> in the header is filled in to indicate the score for the hole.

When the player's ball played from the teeing ground comes to rest on any part of the fairway, the circle under the heading Fairway in Reg is filled in. If it did not hit the fairway in regulation, the circle is left blank. The player has reached the green in regulation when his ball touches any part of the green with two more strokes remaining to score par on the hole.

The header Distance to Green refers to the distance to the center of the green after the ball comes to rest in the fairway or rough following the player's tee shot. Driving distance is calculated from this information, since the distance from all available tees to the green is known from the club registration form. Only the four holes selected by the club are used to calculate driving distance, which, for illustration purposes, are holes 4, 7, 11 and 12 shown in the score card 54. The distance is first entered numerically in the space provided under the heading Distance to Green for convenience and to maintain speed of play. Upon completion of the round, the appropriate circles at area 74 are filled in to enter the numerical distance.

The area 74 includes several matrices 73 of circles, each matrix being identified with the preselected hole. Each column in a matrix represents a place digit and each row represents a number from 0–9. Only one circle from any column can be filled such that the filled in circles represent the distance remaining to the green.

If the player incurred a penalty stroke on a particular hole, the appropriate circle under the heading Penalty is filled in. Otherwise the circle is left blank.

For a Wedge Shot, the circle under the heading Wedge is filled in if one of the wedges is hit as a full or 3/4 shot versus a short chip or pitch. For lower handicappers, it is 70–100 yards while higher handicappers may play this shot with a 9-iron from 100–125 yards. If the player played this shot on a particular hole, the circle is filled in. If the shot is not played, the circle is left blank.

A chip or pitch shot is any shot played around the green that is either a pitch or chip and run shot. If the player played this shot on a particular hole, the circle under the heading Chp/Ptch is filled in. Otherwise, the circle is left blank.

Sand shots played from the green side bunkers and not from fairway bunkers are recorded. If the player made the shot from a green side bunker, the circle under the heading Snd is filled in. If the bunker was avoided, the circle is left blank.

A putt is defined as any shot taken from the putting surface. The appropriate circle under one of the headings <5, 5–10 and 10> is filled in to indicate the length of the first putt. The headings refer to distance. Distance of the first putt is not an exact measurement but rather an estimate and should take no more that a glance to determine the length of the putt.

The total number of strokes played from the putting surface is recorded under the heading Number of Putts. The maximum number of putts recorded is three. If the player had three or more number of putts, the circle under the heading 3> is used.

The heading Shots Before Putt refers to when the player miss-hit a shot out of a trap and has to chip or pitch back to the green. The circle under the heading needs only to be filled in if the player has hit both a chip/pitch shot and sand shot on the same hole. In this situation, the system will calculate how close the player hit his last shot to the flagstick.

Area 76 is provided to enter information on the tees played. This is used for calculating driving distance for the four selected holes provided by the club.

At 78, the player fills in a circle if he played the back nine first. The purpose of the question is to allow the system to track the differences in the player's play on early versus late holes.

Area 80 is used to provide information on whether the player hit some practice shots or putts before starting the round. The appropriate circle corresponding to Woods, Short Irons, Chip/Pitch and Putting is filled in.

The player's identification number is filled in at area 82. This is only necessary if the player is using a score card that was not preprinted with this information.

The date and time of day the player played the rounds are indicated at area 84. The purpose for the "start time" is for the system to track performance sequentially.

The score card 54 is used to record and monitor the player's performance. The score card is advantageously simple to use, since information is entered on an exception basis. Upon completion of a hole, the player records his performance by filling in the appropriate circles to select the data corresponding to the respective circles that applied to the hole just played. A pencil is used to make correcting an error easy by simply erasing the incorrect mark and filling in the correct circle.

Figure 5:
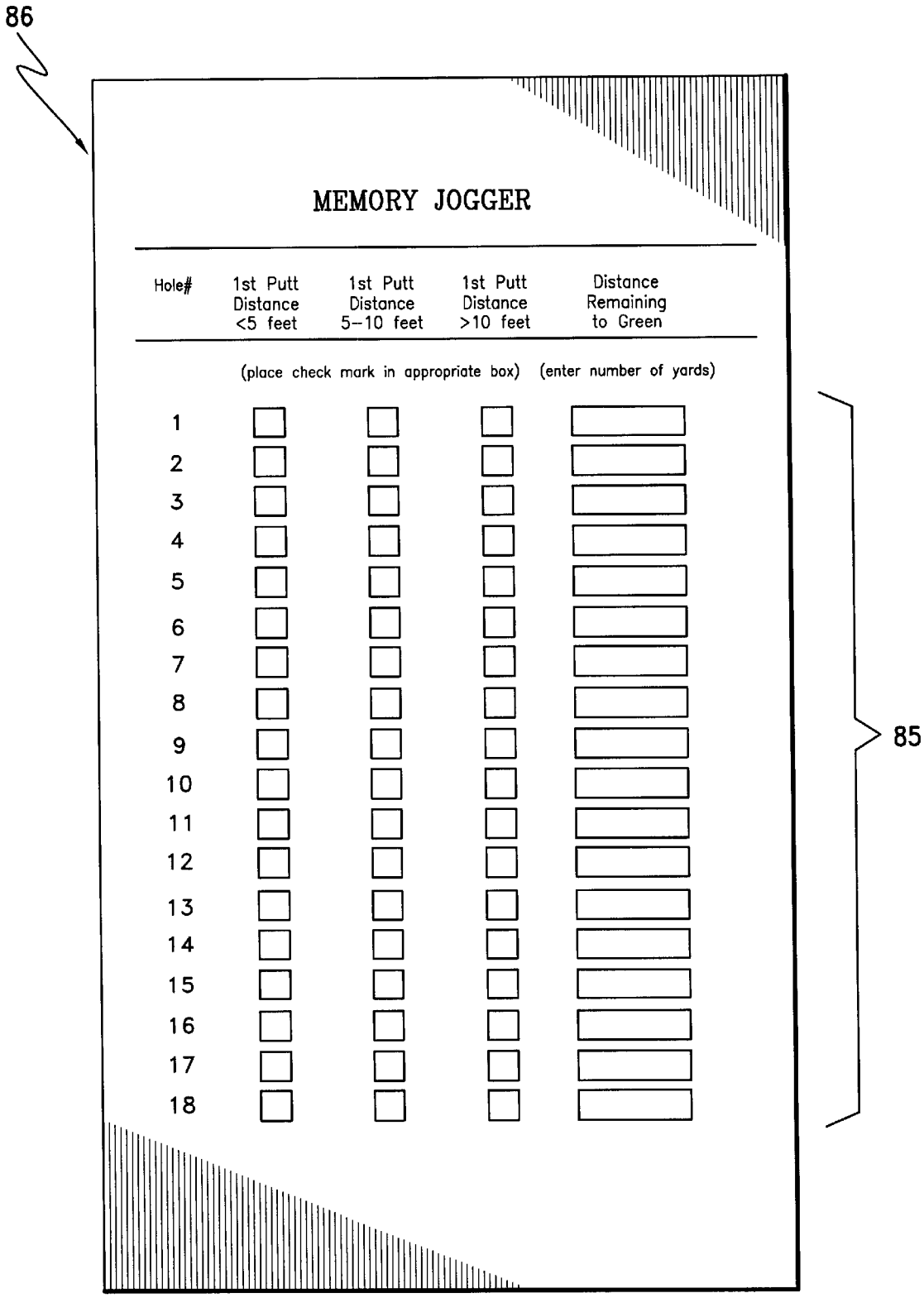
FIG. 5 is a distance entry form used by the player for quick entry of data.

It is preferable that the score card 54 be completed during the round. If the player elects to fill out the score card upon completing the round, it is preferable that the player records the length of the first putts and the distance remaining to the green on the driving holes during the play. A distance entry form 86 is provided for this purpose. The form 86 will allow the player to mark the distance of the first putt and note the distance remaining on the four(4) driving distance holes, as best shown in FIG. 5. The form 86 has a matrix of spaces 85, each row within the matrix corresponding to a pre-printed hole number and each column corresponding to a heading. For recording distance of the first putt, the player enters a mark, such as a check mark, on the appropriate space 85 corresponding to the hole and the heading. Distance remaining to the green is entered numerically in the appropriate space 85.

Figure 6A:
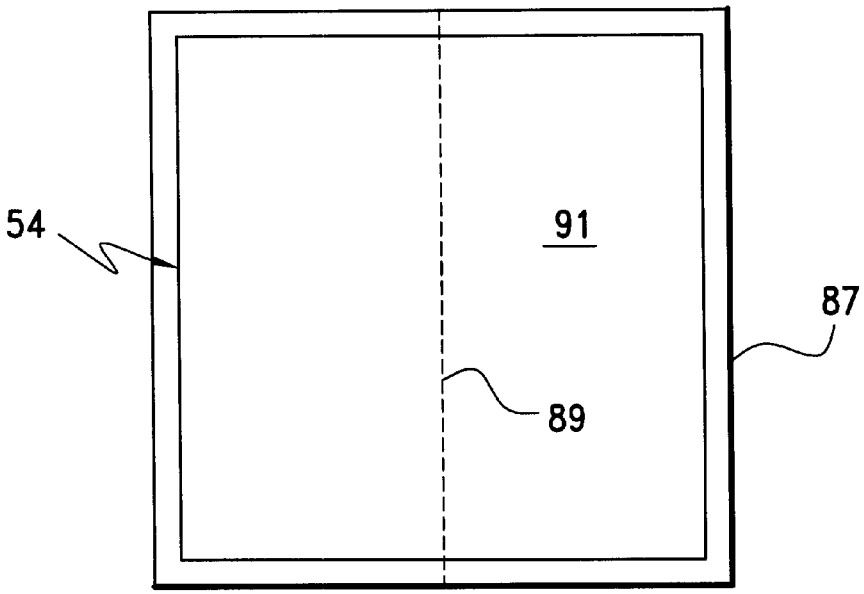
FIG. 6A is a card sheet laid flat, revealing an inside surface on which the score card of FIG. 4 is printed.
Figure 6B:
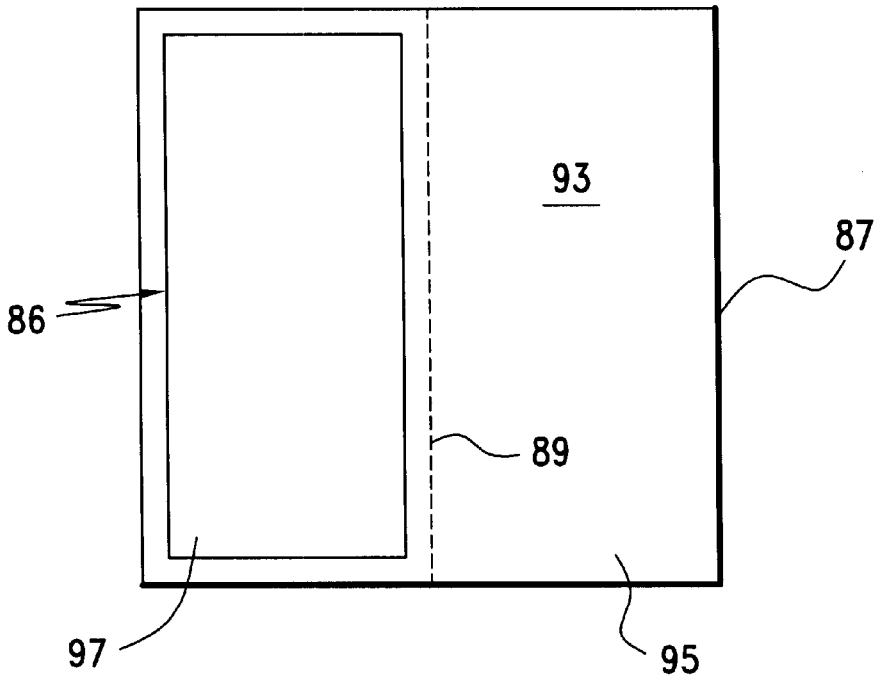
FIG. 6B is a reverse side of FIG. 6A, showing an outside surface on which the distance entry form is printed.

The score card 54 and the distance entry form 86 are advantageously integrated into a single card sheet 87, as best shown in FIGS. 6A and 6B. The sheet 87 includes a foldline 89 along the middle to permit the sheet to be folded into half to define an inner surface 91 and an outer surface 93. The score card 54 is printed on the inside surface 91. The outer surface 93 is divided along the foldline 89 into a front cover surface 95 and back cover surface 97. The distance entry form 86 is printed on the back cover surface 97.

Figure 7:
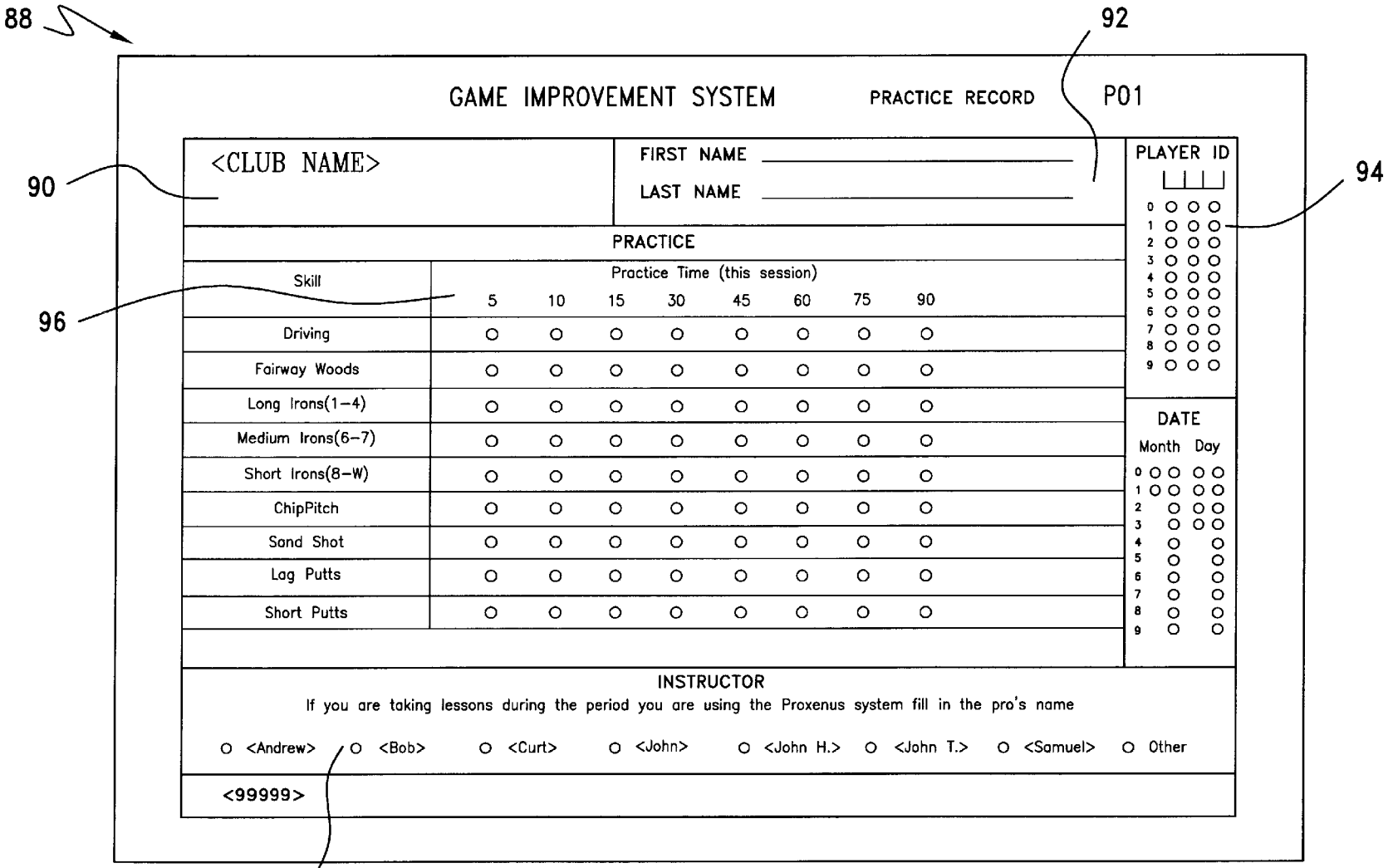
FIG. 7 is a practice record form used in the present invention.

The system monitors the amount of time the player spends off the course practicing the game. Each time the player practices, he fills out a practice record form 88, as best shown in FIG. 7. The comparison of the player's efforts to actual playing experiences will allow the player and his teaching professional to develop more effective practice routines. The practice form 88 includes an area 90 on which is preprinted the club name. Area 92 is preprinted with the player's name. The player's identification number is preprinted at area 64. The Player fills in the amount of time spent practicing for each session on driving, fairway woods, long irons (1–4), medium irons (6–7), short irons (8-W), chip/pitch, sand shots, lag putts, and short putts. This time is indicated at area 96. If a player is working with an instructor, the name of the instructor is indicated at area 98.

Each time the player completes a score card for the 18 holes (one round) or a practice record form, it is entered into the database 2 by standard means, such as an automatic reader that senses the filled in circles. Various conventional quality control checks are made on the data before they are added on the database for analysis. The information is held in the database until the player has recorded eight(8) rounds of play and then the data is managed to produce the report 12, evaluating the player's skills against those of similar or lower handicap. Every time the player completes 8 rounds, the report 12 is generated. The report 12 is an analysis of the player's playing skills, including statistics and charts on his level of play.

Figure 8:
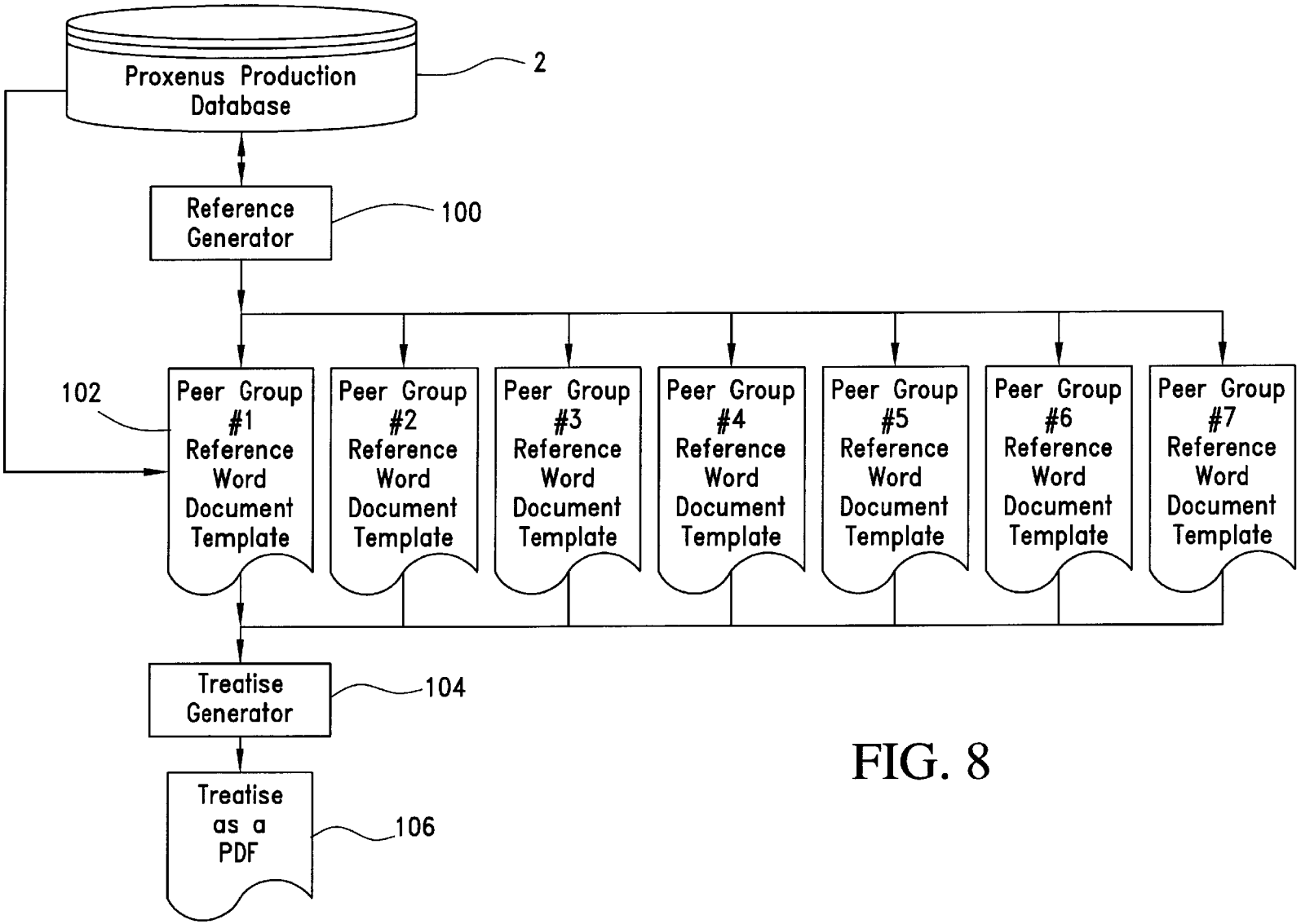
FIG. 8 is a flowchart for generating a report from a database.

Referring to FIG. 8, the database 2 is operated with MICROSOFT SQL SERVER 7.0 running within a standard appropriately configured PC computer. A reference generator 100, using MICROSOFT WORD macro utilizing VBA, is run to create a reference document 102 for each peer group. The created documents 102 are MICROSOFT WORD templates. The reference data in each reference document 102 is computed from individual player data over 8 round periods according to the average handicap for that period. This process also stores various numerical ranges in the database for computing percentiles and rankings during the creation of individual reports 12.

A report generator 104, a MICROSOFT WORD macro utilizing VBA, is run to create individual player reports 12. The player's handicap over the current reporting period determines which reference template is to be used. Player data is inserted into the template where needed to create the final report. ADOBE ACROBAT WRITER is used to print report to a PDF file 106. Multiple workstations are run in parallel to create the reports 12 by accessing the production database. An example of the report 12 is attached herewith as an appendix.

The players are arrayed into peer groups according to handicap as follows:

Handicap

Peer Group 1 3 and Under

Peer Group 2 4–7

Peer Group 3 8–11

Peer Group 4 12–15

Peer Group 5 16–19

Peer Group 6 20–24

Peer Group 7 25+

The player's shot making skills are compared to players in the same handicap group, providing a reference for judging the player's skills. The player is assigned to a peer group on the basis of the average handicap reported over the 8 rounds in the report.

The system also provides a second group to which the player's game is compared. This group is termed Next Lower Peer Group and is the peer group whose handicap range is just below the player's handicap. For example, if a player is in Peer Group 5, the Next Lower Peer Group is Peer Group 4.

The system uses percentiles, which is the percentage of players in the player's peer group that are less skilled than the player to state any particular skill, to compare the player's particular skill to his peer group.

The system uses the following conventions for describing or rating player performance.

| Percentile | Percent of Players | Descriptive Phrase |
|---|---|---|
| 100 | 1% | Top 1% |
| 86–99 | 14% | Very High, Excellent |
| 66–85 | 20% | High, Good |
| 36–65 | 30% | Medium, Average |
| 16–35 | 20% | Low, Fair |
| 2–15 | 14% | Very Low, Poor |
| 1 | 1% | Bottom 1% |

The data from the player's score card and practice form are managed to provide various statistics presented in descriptive and graphical formats, analyzing and comparing the player's playing skills, namely, driving, approaching, full wedge play, chipping and pitching, sand saving, putting, and penalty avoidance relative to his peer group and the next lower peer group. The various statistics, in graphical and descriptive formats, are included in the report 12 and are discussed below.

Figure 9A:
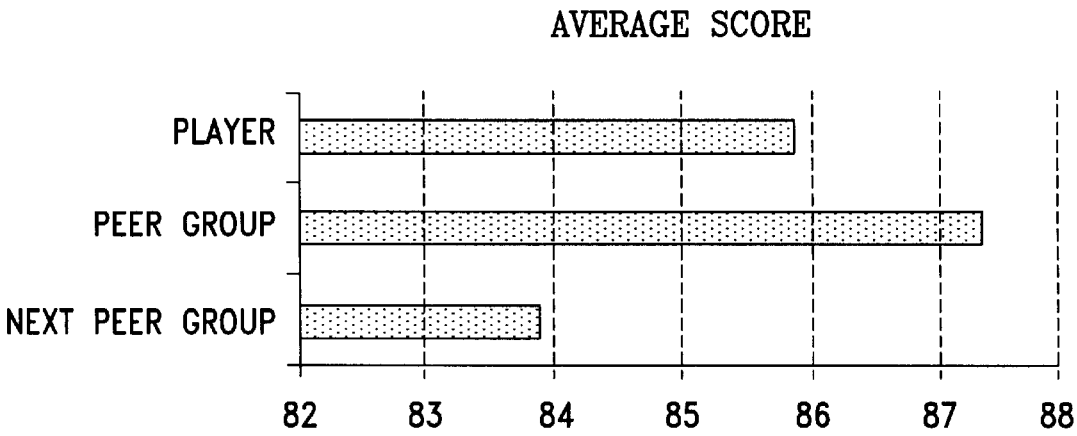
FIGS. 9A–9J are graphical representations of some statistics generated from the database.

Referring to FIG. 9A, the player's average score is compared to his peer group and the next lower peer group. Score is emphasized less than the skills that determined it, namely, driving, approaching, full wedge play, chipping and pitching, sand saving, putting, and penalty avoidance. As the player's playing skills improve, the score will also improve. Other statistical data that may be presented regarding the player's score include the player's percentile ranking within his peer group and the next lower peer group, "hottest scoring streak", worst scoring streak, holes played best and the average score over these holes.

Figure 9B:
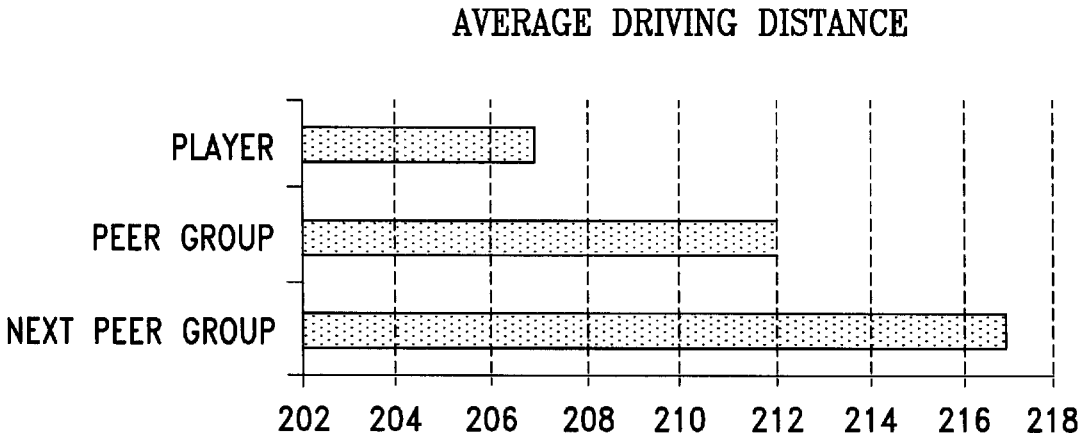

Referring to FIG. 9B, the player's average driving distance is compared to his peer group and to the next lower peer group. Distance off the tee is critical to course management strategies. Driving distance is calculated as total distance minus the distance remaining to a green following a tee shot. The distance between the tee and the green is recorded on two holes on each nine hole course chosen by the club professional to best reflect the player's driving skill. The distance remaining to the green is calculated on the basis of tee markers being played. The player's percentile ranking relative to his peer group and the next lower peer group may be provided. The player's driving distance is also compared to his last report driving distance.

Figure 9C:
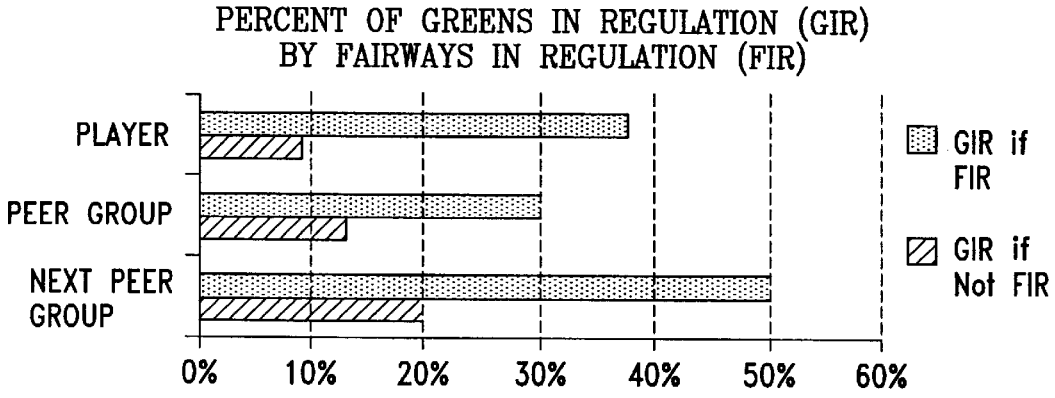

Referring to FIG. 9C, the player's percent of greens in regulation versus fairways in regulation is shown. This skill is a measure of the player's driving accuracy. Other statistics provided may include percent of time the player's drives reached the fairway in regulation and the corresponding percentile ranking, whether the player's driving accuracy changed from last report, percent of time the player's peer group reached the fairway in regulation, percent of time the next lower peer group reached fairways in regulation, percent of green when the player reached the fairway in regulation, percent of green when the player did not reach the fairway in regulation, percent of time the player scored par or better in terms of whether he reached or did not reach the fairway in regulation, and percent penalties in terms of when the fairway in regulation is reached or not reached.

Figure 9D:
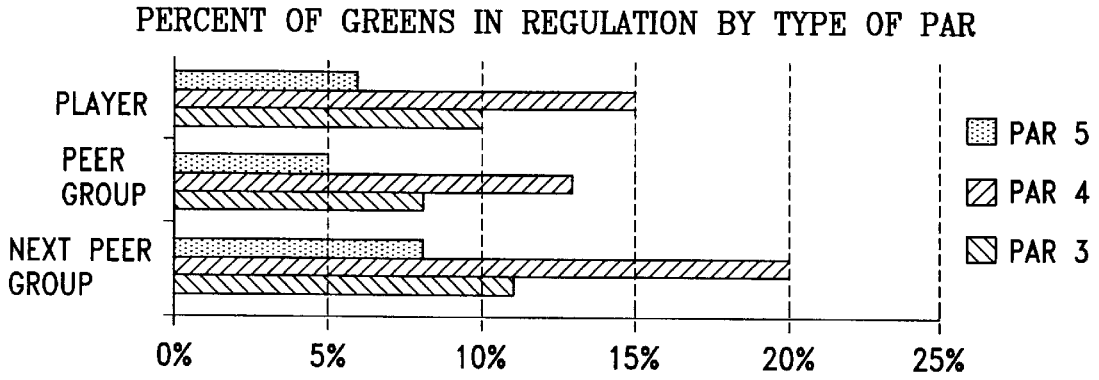

The percent of greens hit in regulation is calculated as the number of greens hit in regulation divided by 18. A green is said to be hit in regulation whenever a player's ball comes to rest on any part of the green with a score of two less than hole par or better. FIG. 9D shows the percent of greens in regulation by type of par. Other statistics provided may include percentile ranking, percent of time the player's approach shot landed within 10 feet of the hole.

Figure 9E:
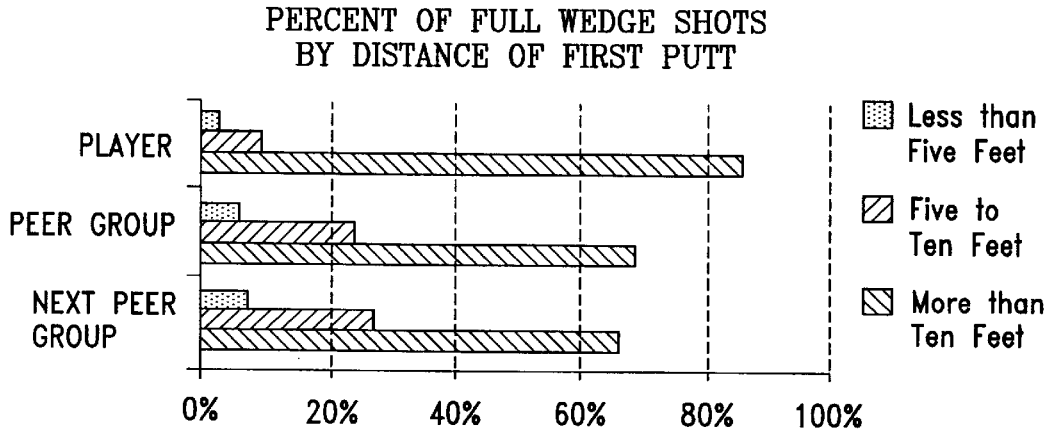

A full wedge play is defined as hitting one of the player's wedges as a full wedge versus a short chip or pitch. The distance of the shot can vary by skill level but is a shot that is expected to get close to the pin. For lower handicap player, the distance is 70–100 yards, while higher handicap player may play this shot with a 9 iron from 100–125 yards. Referring to FIG. 9E, the player's full wedge playing skill is shown by distance of the first putt. Other statistics may include average number of full wedge shots versus last period, and percentile ranking.

Figure 9F:
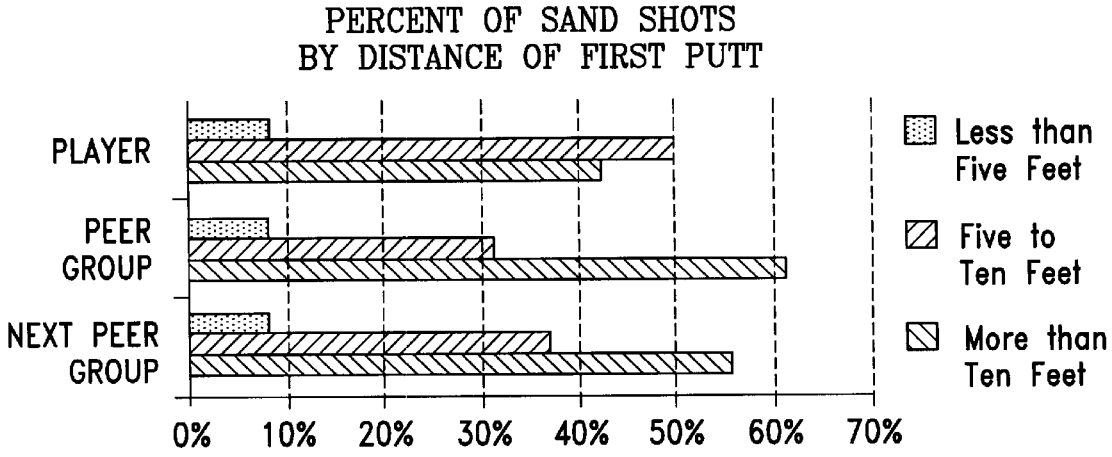

A sand save is the ability to escape a green side bunker with a shot that is close enough to finish the hole with one putt or less. FIG. 9F shows the player's percent sand shots by distance of first putt. Other statistics provided may include average number of sand shots this report period versus last period, percent success getting up and down when sand saving, percentile ranking, percent of time the player is able to get down in two putts or fewer following a sand shot from a green bunker, and percent of time the player's sand shot landed within 10 feet of the hole.

Figure 9G:
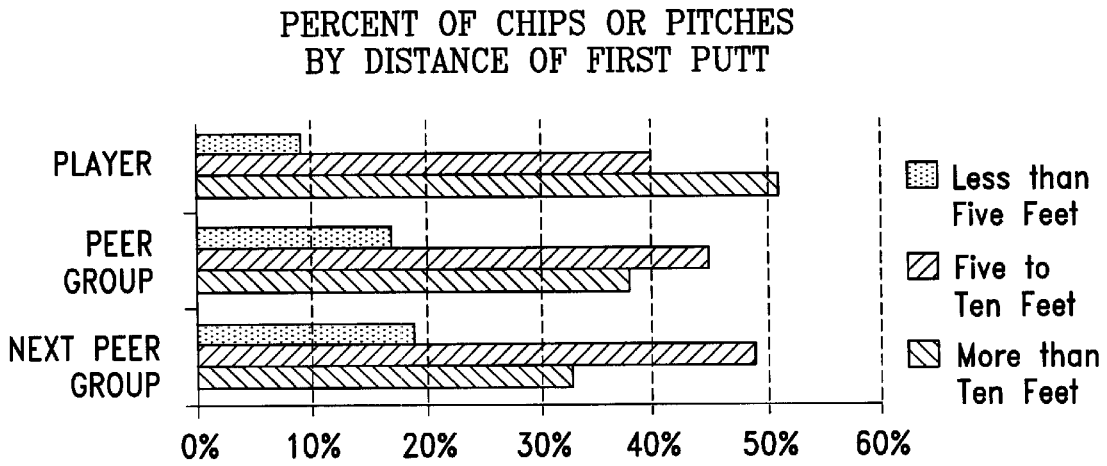

Chipping and pitching is any shot played around the green that is either a pitch or a chip shot. A chip or pitch up and down is defined as any occasion when the player gets down in one stroke or less after a chip or pitch shot. The player's chipping and pitching ability is shown in FIG. 9G in terms of percent of chips or pitches by distance of first putt. Other statistics presented may include average number of chip or pitch shots this report period versus last period, percent success in getting down in two or fewer putts when chipping or pitching, and percentile ranking.

Figure 9H:
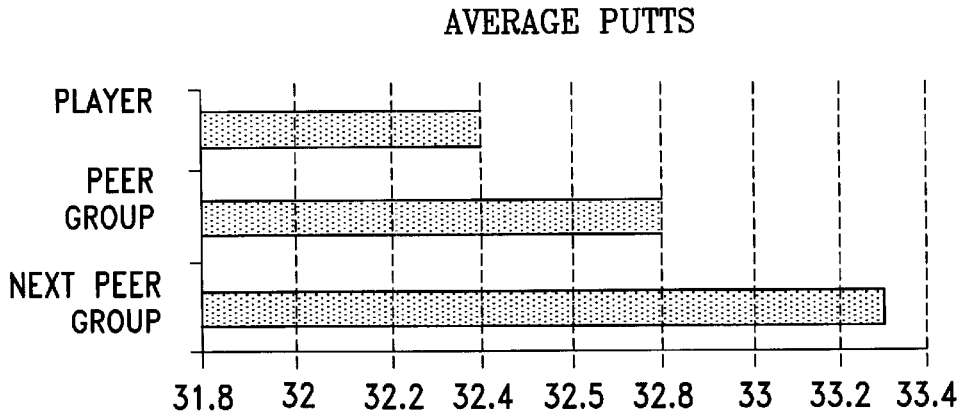

Referring to FIG. 9H, the player's putting skill is shown in terms of his average number of putts distance per round. Putting is any stroke that occurs on the green. The player's putting skill is evaluated in terms of total putts, average putts, putting score (no putts, one putt, etc.) and length of first putt. The impact on the putting is observed by the type of shot last hit before reaching the green. Other statistics presented may include percentile ranking, the average putts when the green is reached after hitting a chip or pitch shot, the average putts when the green is reached after hitting a full wedge shot, percent of time getting up or down when approaching from the sand, when playing full wedges and when chipping or pitching, percent of putts within 10 feet, and percent of putts within 5 feet.

Figure 9I:
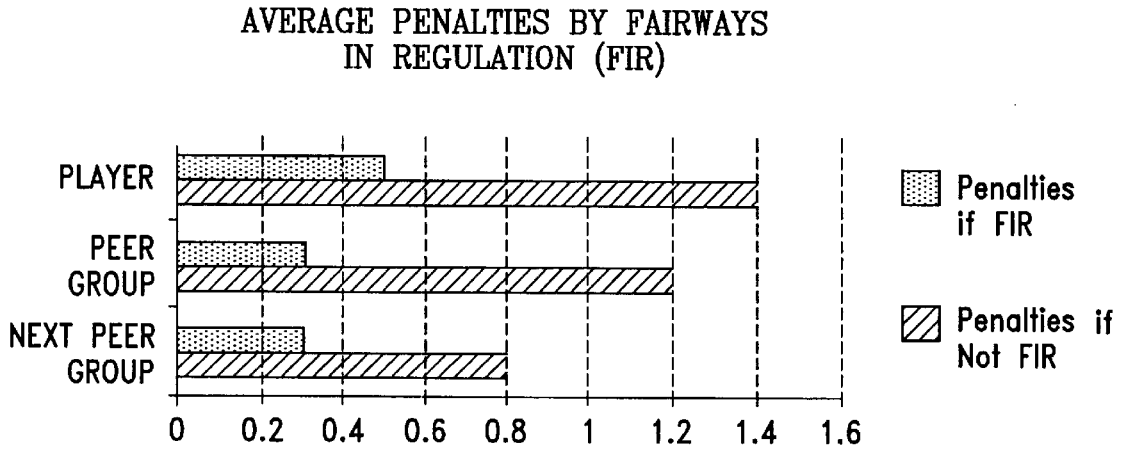

A penalty occurs whenever a ball is hit out of bounds, lost, or lands in a water hazard or for a variety of rule violations. The most serious penalty is the out of bounds penalty since it involves both stroke and loss of distance. Avoiding penalties is an important skill. By tracking the average incidence of penalty and the holes most prone to penalty, the player can quickly spot opportunities for improving course management skills and saving strokes. Other statistical data for analyzing the player's penalty saving skill may include average penalties per round, average number of penalties for holes when the fairway in regulation is reached and the holes where the penalties tended to occur. FIG. 9I shows the average penalties by fairways in regulation.

Figure 9J:
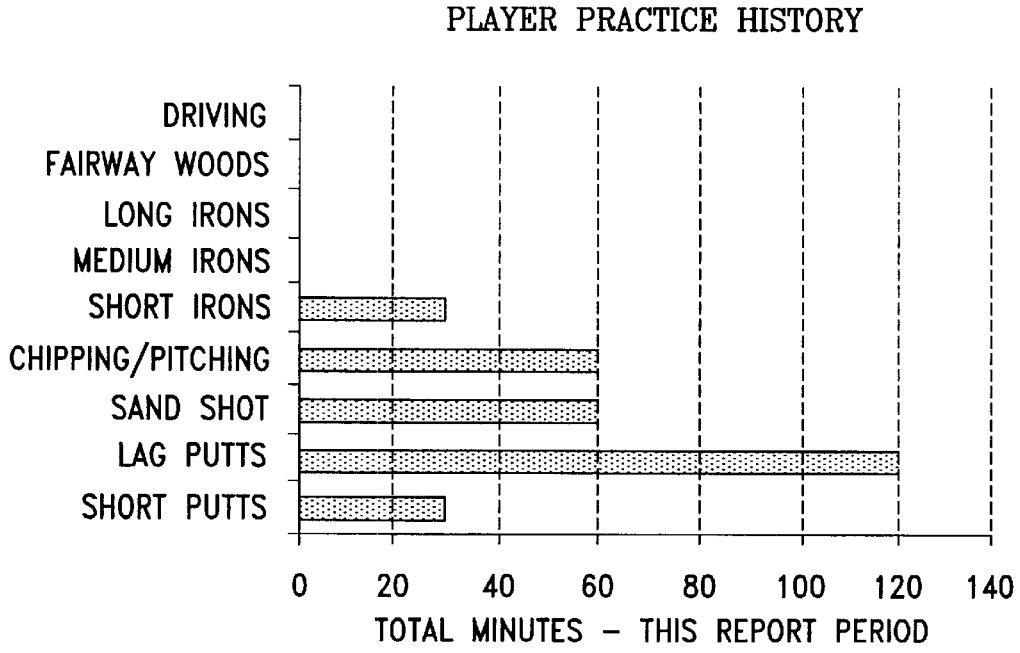

The present invention monitors the time spent off the course practicing the game. Pertinent statistics may include comparison of time spent practicing versus the player's peer group, percent of time practicing certain types of shots, and the average putts per round and time spent practicing putting this report period compared to the last report. FIG. 9J shows the player's practice history in terms of time spent practicing certain shots.

The report 12 is a multi-page report including a cover page, a definition page, a quick review page, a summary page, a one page description of each playing skill, and a statistical appendix.

The cover page includes the name of the player and the names of the club and head professionals, the dates of the player's first and final rounds in the analysis and the average handicap during the period the eight rounds were played.

The definition page defines handicap ranges for each peer group in the system and use of percentile in comparing the player's play to other peer groups and the basis for the various descriptive phrases use in the report.

The quick review page provides a one page summary chart that details the player's playing ability versus fourteen playing skills, comparing the player's skill levels to the previous report, his peer group and the next lower peer group.

The summary page reviews the player's performance level in ten important skills, including scores, driving distance, fairways in regulations, greens in regulations, full wedge play, sand saves, chipping and pitching, putting, penalties and practice.

The descriptions of skills section provides a one page report devoted to each of the playing skills, namely, driving distance, fairways hit in regulation, greens hit in regulation, wedge play, chipping/pitching accuracy, sand saves, putting, penalties, and practice. Each page details the player's performance versus that of his peer group and next lower peer group on each of the skills.

The statistical appendix contains several pages of charts on the player's game, making it easy for him to spot strength and weaknesses. A few things covered in this section include average number of penalties per round, percent of time the player gets up and down from the sand, percent of time the player chips or pitches close enough to 1- or 2-putt, average driving distance, fairways in regulation, average number of putts, whether the player putts better when he practices putting before playing, whether the score is better when the player practices his irons and woods before playing, whether the play is consistent throughout the rounds or whether he plays better earlier or later in the round, how close to the flag stick his shots are from various distances, how close to the flag stick he hits the shots on all par 3's, how close to the flag stick he hits his wedge shot, and how effective his practice sessions are.

The club professional will also receive a summary of the player's report 12 and he is available to schedule a lesson with the player to review the report.

The present invention is designed to fit within the traditions of the game and not as a computer solution or electronic game. It is for this reason that the score card is designed for manual entry as opposed to a computerized record keeping device. The present invention is designed to identify and analyze the problems and opportunities. It is designed as a teaching tool which may be used by the club professional in customizing the lessons he gives to the player.

The present invention will create a road map that the player and the teaching professional can follow to attain lower scores and a significant improvement in playing ability. The golfing community defines a marker as one who is appointed by the golf committee to report competitor's scores and strokes play. The present invention will function as a personal marker that accompanies a player during a round to gather important facts that will lead a greater understanding and appreciation of the game.

Over time, the computerized database will grow, as more and more players and clubs use the system. As the database accumulates more data on players of various skill levels and courses of varying difficulties, the system will provide even greater insights on the player's performance.

The various forms disclosed herein use circles for ease of filling in, but other shapes can used that can be filled in and be recognized by a standard electronic reader.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A golf improvement system, comprising:

a) a club and course registration form containing information about a course including par of each hole and distance from a tee to a green;

b) a player score card for recording a round of golf played by the player on the course, said score card including a plurality of circles corresponding to each hole, each circle when filled in corresponds to a data entry concerning the hole being played;

c) a computerized database containing information from said club and registration form, said player score card, and information on the player's peer group;

d) a report generated by said computerized database and containing statistics on the player's playing skills;

e) said score card including an area for data entry for distance remaining to green for a preselected hole; and f) said area including at least one matrix of circles identified with the preselected hole, each column in the matrix representing a place digit, each row in the matrix representing a number from 0–9, wherein only one circle from any column can be filled in such that the filled in circles represent the distance remaining to green.

2. A golf improvement system as in claim 1, wherein:

said data entry includes a score for the hole.

3. A golf improvement system as in claim 1, wherein:

said data entry includes the player's reaching the fairway in regulation.

4. A golf improvement system as in claim 1, wherein:

said data entry includes the type of shots used by the player.

5. A golf improvement system as in claim 1, wherein:

said data entry includes the player's using a penalty shot, full wedge shot, chip or pitch shot and sand shot.

6. A golf improvement system as in claim 1, wherein:

said data entry includes the distance of a first putt.

7. A golf improvement system as in claim 1, wherein:

said data entry includes the distance of the first putt being less than 5 feet, 5–10 feet or greater than 10 feet.

8. A golf improvement system as in claim 1, wherein:

said data entry includes the number of putts.

9. A golf improvement system as in claim 1, wherein:

said data entry includes the type of shot made before a putt.

10. A golf improvement system as in claim 1, wherein:

said data entry includes a chip or pitch shot or a sand shot before a putt shot.

11. A golf improvement system as in claim 1, and further comprising:

a) a practice record form to be filled by the player when practicing off the course; and b) said computerized database includes information from said practice record form.

12. A golf improvement system as in claim 11, wherein:

a) said practice form includes a listing of shots;

b) a row of circles corresponding to each shot; and c) each circle corresponding to an amount of time spent practicing a shot.

13. A golf improvement system as in claim 1, wherein:

said report includes a graphical representation of the player's playing skills as compared to the player's peer group.

14. A golf improvement system as in claim 13, wherein:

said report includes statistical information on the player's scores, driving distance, fairways in regulation, greens in regulation, full wedge play, sand saves, chipping and pitching, putting, penalties and practice time.

15. A golf improvement system, comprising:

a) a club and course registration form containing information about a course including par of each hole and distance from a tee to a green;

b) a player score card for recording a round of golf played by the player on the course, said score card including a plurality of circles corresponding to each hole, each circle when filled in corresponds to a data entry concerning the hole being played;

c) a computerized database containing information from said club and registration form, said player score card, and information on the player's peer group;

d) a report generated by said computerized database and containing statistics on the player's playing skills;

e) a distance entry form including a listing of holes on the course; and f) areas disposed on said distance entry form for recording the distance of a first putt and distance remaining to the green corresponding to the hole.

16. A golf improvement system as in claim 15, wherein:

a) said distance entry form includes a matrix of spaces, each row of spaces corresponding to a hole and each column corresponding to a range of distance; and b) each space being adapted to receive a mark to indicate the range of distance of the hole corresponding to the position of the marked space in said matrix.

17. A golf improvement system as in claim 16, wherein:

said form is disposed on a reverse side of said score card.

18. A device for keeping record of a player's playing ability during a round of golf, comprising:

a) a score card for recording a round of golf played by the player on a course;

b) said score card including a list of holes disposed along a vertical axis and a list of selectable data disposed along a horizontal axis;

c) a plurality of rows of circles, each row corresponding to each hole, each circle in said row corresponding to one of said selectable data such that a circle when filled in represents a data entry for the hole being played and the corresponding selectable data;

d) a distance entry form including a listing of holes on the course; and e) areas disposed on said distance entry form for recording the distance of a first putt and distance remaining to the green corresponding to the hole.

19. A device as in claim 18, wherein:

said selectable data includes a row of numbers, each number corresponding to a possible score for the hole.

20. A device as in claim 18, wherein:

said selectable data includes the player's reaching the fairway in regulation.

21. A device as in claim 18, wherein:

said selectable data includes the type of shots used by the player.

22. A device as in claim 18, wherein:

said selectable data includes penalty shot, full wedge shot, chip or pitch shot and sand shot.

23. A device as in claim 18, wherein:

said selectable data includes the distance of a first putt.

24. A device as in claim 18, wherein:

said selectable data includes the distance of the first putt being less than 5 feet, 5–10 feet or greater than 10 feet.

25. A device as in claim 18, wherein:

said selectable data includes the number of putts.

26. A device as in claim 18, wherein:

said selectable data includes the type of shot before a putt.

27. A device as in claim 18, wherein:

said selectable data includes a chip or pitch shot or a sand shot before a putt shot.

28. A device as in claim 18, wherein:

said selectable data includes the distance remaining to the green.

29. A device as in claim 18, wherein:

a) said distance entry form includes a matrix of spaces, each row of spaces corresponding to a hole and each column corresponding to a range of distance; and b) each space being adapted to receive a mark to indicate the range of distance of the hole corresponding to the position of the marked space in said matrix.

30. A device as in claim 18, wherein:

a) said distance entry form is disposed on a reverse side of said score card.

31. A device as in claim 18, wherein:

a) said score card is foldable along a centerline; and b) said distance entry form is disposed on a reverse side of said score card.

* * * * *